US007208884B2

(12) United States Patent
Bao et al.

(10) Patent No.: US 7,208,884 B2
(45) Date of Patent: Apr. 24, 2007

(54) DISCHARGE LAMP LIGHTING CIRCUIT WITH AN OPEN PROTECTION CIRCUIT

(75) Inventors: Wei-De Bao, Guangdong (CN); Kuan-Hong Hsieh, Guangdong (CN)

(73) Assignees: Hong Fu Jin Precision Industry (Shen Zhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 14 days.

(21) Appl. No.: 11/163,471

(22) Filed: Oct. 20, 2005

(65) Prior Publication Data

US 2006/0145631 A1 Jul. 6, 2006

(30) Foreign Application Priority Data

Dec. 30, 2004 (CN) ..... 2004 1 0091963

(51) Int. Cl.
*H05B 39/00* (2006.01)
*H05B 41/36* (2006.01)

(52) U.S. Cl. ..... 315/244; 315/224; 315/209 R; 315/208; 315/360; 315/247; 315/219; 315/225

(58) Field of Classification Search ..... 315/224, 315/244, 219, 291, 209 R, 247, 225, 208
See application file for complete search history.

(56) References Cited

U.S. PATENT DOCUMENTS 5,363,020 A * 11/1994 Chen et al. ..... 315/209 R
5,652,479 A * 7/1997 LoCascio et al. ..... 315/225
5,818,707 A * 10/1998 Seong et al. ..... 363/89
5,844,378 A * 12/1998 LoCascio et al. ..... 315/307
6,555,972 B1 * 4/2003 Lestician ..... 315/224
6,710,555 B1 3/2004 Terada et al. ..... 315/291
6,864,645 B2 * 3/2005 Sun et al. ..... 315/308

* cited by examiner

*Primary Examiner*—Tho Phan
*Assistant Examiner*—Chuc Tran
(74) *Attorney, Agent, or Firm*—Winston Hsu

(57) ABSTRACT

A discharge lamp lighting circuit includes an open protection circuit. The discharge lamp lighting circuit includes an open protection circuit and an over-voltage detecting circuit. The open protection circuit detects whether any of the discharge lamps are unlit, and sends a voltage control signal to a control circuit if one of the discharge lamps is not lit, whereby the control circuit sends a pulse signal to a buck converter according to the voltage control signal, and the buck converter generates and outputs a DC voltage according to the pulse signal. If the DC voltage from the buck converter reaches a predetermined voltage, the over-voltage detecting circuit conducts and sends a voltage control signal to the control circuit, and the control circuit ceases operating according to the voltage control signal. Consequently, damage to the other normal discharge lamps is prevented.

9 Claims, 3 Drawing Sheets

DISCHARGE LAMP LIGHTING CIRCUIT WITH AN OPEN PROTECTION CIRCUIT

FIELD OF THE INVENTION

The present invention relates to a discharge lamp lighting circuit, and more particularly to a discharge lamp lighting circuit with an open protection circuit.

DESCRIPTION OF RELATED ART

A discharge lamp, especially a rare-gas discharge lamp, is used in lighting devices, various scanners, and Liquid Crystal Displays (LCDs). A discharge lamp has a rare gas such as xenon filled in a glass tube, the rare gas functioning as a discharge gas; and fluorescent material coated on the inner wall of the glass tube. The discharge lamp is generally lit up by applying a high voltage thereto. The high voltage is obtained by converting a direct current (DC) power source. The voltage waveform induced in a transformer is oscillated by a resonant circuit composed of an inductance of the transformer and a stray capacitance at the time of switching. The voltage is applied to the semiconductor used for driving, and the secondary voltage of the transformer rises. When a rare-gas discharge lamp is not connected or is unlit, the primary voltage of the transformer continues to rise, which may damage the semiconductor. At the same time, the secondary voltage of the transformer also rises further, continuously generating a high voltage equivalent to the starting voltage. This may result in dielectric breakdown of the transformer.

In order to solve the above problems, a discharge lamp lighting circuit with an open protection circuit has been devised. Referring to FIG. 3, an exemplary such discharge lamp lighting circuit includes: a driving means to send a signal for lighting a discharge lamp; a control means to control the driving means; a short protection means to protect the driving means by sending a signal to the control means when the discharge lamp is shorted; and an open protection means to protect the driving means by sending a signal to the control means when the discharge lamp is not connected or is unlit. The open protection means is adapted to send a signal to the control means for limiting a current flowing through the driving means to be at or below a predetermined value when the current is equal to or lower than a predetermined first value, and a signal for sequentially increasing a current flowing through the driving means up to a rated current when the current is higher than the first value and also is equal to or lower than a predetermined second value. The open protection means is also used to stop a driving signal sent from the control means when a current flowing through the discharge lamp has a value equal to or lower than the first value after a predetermined time. Therefore, the discharge lamp lighting circuit can be protected when the discharge lamp is in an open state. However, the invention only discloses a technique involving a discharge lamp lighting circuit with one discharge lamp.

Therefore, a heretofore unaddressed need exists in the industry to overcome the aforementioned deficiencies and inadequacies.

SUMMARY OF INVENTION

A discharge lamp lighting circuit with an open protection circuit is provided for detecting a current of one or more discharge lamps, and for stopping a current flowing to a buck converter when a discharge lamp is not connected or is unlit.

In one preferred embodiment, the discharge lamp lighting circuit with an open protection circuit includes: a control circuit to output a pulse signal with a duty cycle; a buck converter to receive the pulse signal, and lower a direct current (DC) voltage flowing therethrough according to the duty cycle of the pulse signal; a resonant converter to convert the DC voltage output from the buck converter into an alternating current (AC) voltage, and to increase the AC voltage; one or more discharge lamps to be supplied power by the AC voltage; a feedback circuit to convert a current flowing through the discharge lamps into a control signal, and to feedback the control signal to a control circuit, wherein the control circuit, the buck converter, the resonant converter, the one or more discharge lamps and the feedback circuit are connected in series; an open protection circuit being connected in series between the one or more discharge lamps and the control circuit, to detect a current flowing through each discharge lamp and send a first control signal to the control circuit when one of the discharge lamps is disconnected or unlit, whereby the control circuit sends a pulse signal to the buck converter, and the buck converter outputs a high voltage according to the pulse signal; an over-voltage detecting circuit, one end of which is connected between the buck converter and the resonant converter and the other end of which is connected to the control circuit, to detect the DC voltage output from the buck converter, wherein a second control signal is sent to the control circuit when the DC voltage is higher than a predetermined value thereby causing the control circuit to stop outputting the pulse signal, whereupon the buck converter ceases operation.

The open protection circuit includes one or more open detecting circuits, a feedback circuit, and an open control circuit. The over-voltage detecting circuit includes a voltage-regulator diode, a second resistor, and a third resistor, with a cathode of the voltage-regulator diode being connected to the buck converter, an anode of the voltage-regulator diode being connected to one end of the second resistor, and the other end of the second resistor being connected to the control circuit and grounded via the third resistor.

Other systems, methods, features, and advantages will be or become apparent to one with skill in the art upon examination of the following drawings and detailed description. It is intended that all such additional systems, methods, features, and advantages be included within this description, be within the scope of the present invention, and be protected by the accompanying claims.

DETAILED DESCRIPTION

Figure 1:
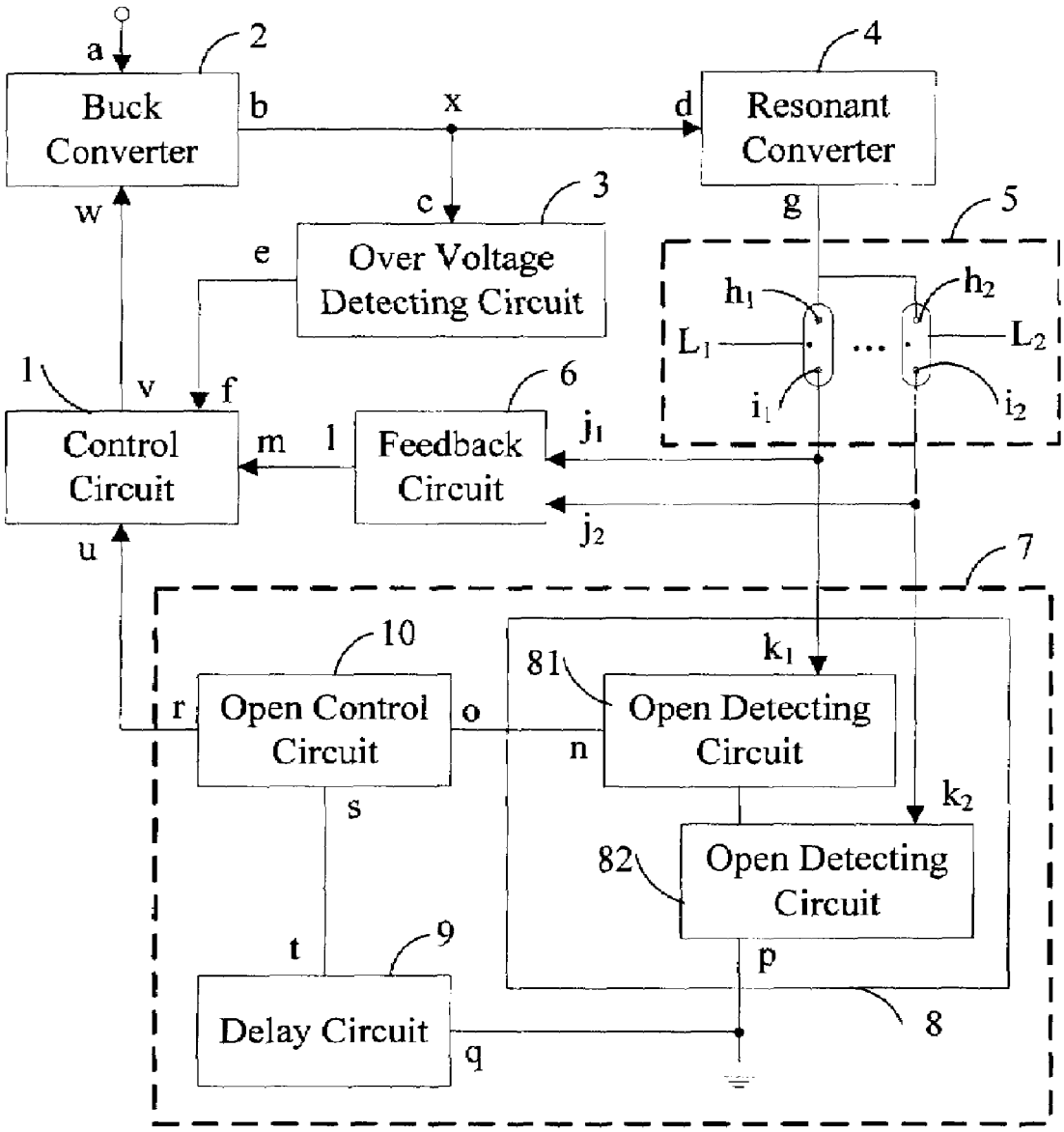
FIG. 1 is a block diagram of a discharge lamp lighting circuit with an open protection circuit according to a preferred embodiment of the present invention.

FIG. 1 is a block diagram of a discharge lamp lighting circuit with an open protection circuit in accordance with a preferred embodiment of the present invention. In this embodiment, the discharge lamp lighting circuit includes a control circuit 1, a buck converter 2, an over-voltage detecting circuit 3, a resonant converter 4, discharge lamps 5, a feedback circuit 6, and an open protection circuit 7. The open protection circuit 7 includes open detecting circuits 8, a delay circuit 9, and an open control circuit 10. The discharge lamps 5 can be one or more discharge lamps. In the illustrated embodiment, for simplicity, two discharge lamps $L_1$ and $L_2$ are depicted. The discharge lamps 5 may be a kind of rare-gas discharge lamps, such as fluorescent lamps, xenon lamps, and/or Cold Cathode Fluorescent Lamps (CCFLs).

An output terminal 'v' of the control circuit 1 is connected to an input terminal 'w' of the buck converter 2. An input terminal 'a' of the buck converter 2 is connected to a direct current (DC) power supply (not shown). An output terminal 'b' of the buck converter 2 is respectively connected to an input terminal 'c' of the over-voltage detecting circuit 3 and an input terminal 'd' of the resonant converter 4. An output terminal 'e' of the over-voltage detecting circuit 3 is connected to an input terminal 'f' of the control circuit 1. An output terminal 'g' of the resonant converter 4 is connected to an input terminal (symbolically depicted as $h_1$, $h_2$) of each discharge lamp 5. An output terminal (symbolically depicted as $i_1$, $i_2$) of each discharge lamp 5 is respectively connected to an input terminal (symbolically depicted as $j_1$, $j_2$) of the feedback circuit 6, and to an input terminal (symbolically depicted as $k_1$, $k_2$) of each open detecting circuit 8. An output terminal 'l' of the feedback circuit 6 is connected to an input terminal 'm' of the control circuit 1. An output terminal 'n' of the open detecting circuits 8 is connected to an input terminal 'o' of the open control circuit 10. An output terminal 'p' of the open detecting circuits 8 is connected to an input terminal 'q' of the delay circuit 9. An output terminal 't' of the delay circuit 9 is connected to an input terminal 's' of the open control circuit 10. An output terminal 'r' of the open control circuit 10 is connected to an input terminal 'u' of the control circuit 1.

When the discharge lamp circuit is powered by a primary power source (not shown), the control circuit 1 generates a normal pulse signal with a default duty cycle to the buck converter 2. The buck converter 2 receives a DC voltage from the DC power supply, and converts the DC voltage into a lower DC voltage according to the normal pulse signal from the control circuit 1. The resonant converter 4 converts the lower DC voltage from the buck converter 2 into a higher AC voltage so as to light the discharge lamps 5. Driven by the higher AC voltage, each of the discharge lamps 5 is normally lit, and respectively outputs an AC signal to the feedback circuit 6 and the open protection circuit 7. Receiving the AC signal from the discharge lamps 5, the feedback circuit 6 feedbacks a first voltage control signal to the control circuit 1. Receiving the first voltage control signal, the control circuit 1 continuously outputs the normal pulse signal, thereby forming a loop circuit. In addition, the open protection circuit 7 does not conduct when all the discharge lamps 5 are normally lit, whereas the open protection circuit 7 produces a second voltage control signal to the control circuit 1 when any of the discharge lamps 5 is not lit. Receiving the second voltage control signal, namely the discharge lamps being unlit, the control circuit 1 outputs a pulse signal with a predetermined duty cycle to the buck converter 2. The buck converter 2 converts the current DC voltage into a higher DC voltage according to the particular pulse signal from the control circuit 1. Being driven by the higher DC voltage from the buck converter 2, the over-voltage detecting circuit 3 outputs a third voltage control signal to the control circuit 1. When receiving the third voltage control signal, the control circuit 1 stops its operation. Thereupon the buck converter 2 stops outputting the higher DC voltage to the resonant converter 4, thereby preventing damage to the discharge lamps 5.

Figure 2:
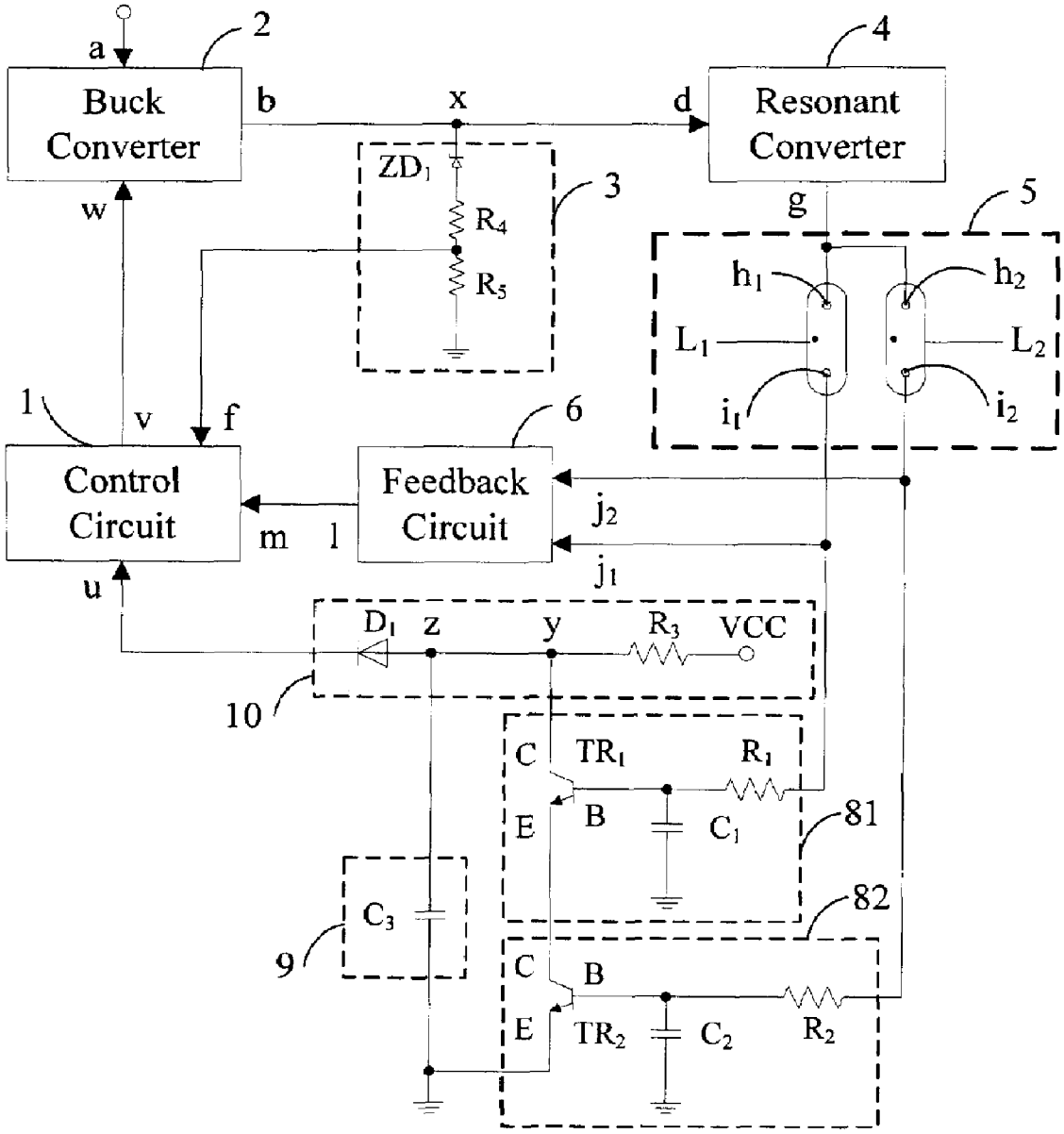
FIG. 2 is a block diagram showing circuitry of a discharge lamp lighting circuit with an open protection circuit according to a preferred embodiment of the present invention.
Figure 3:
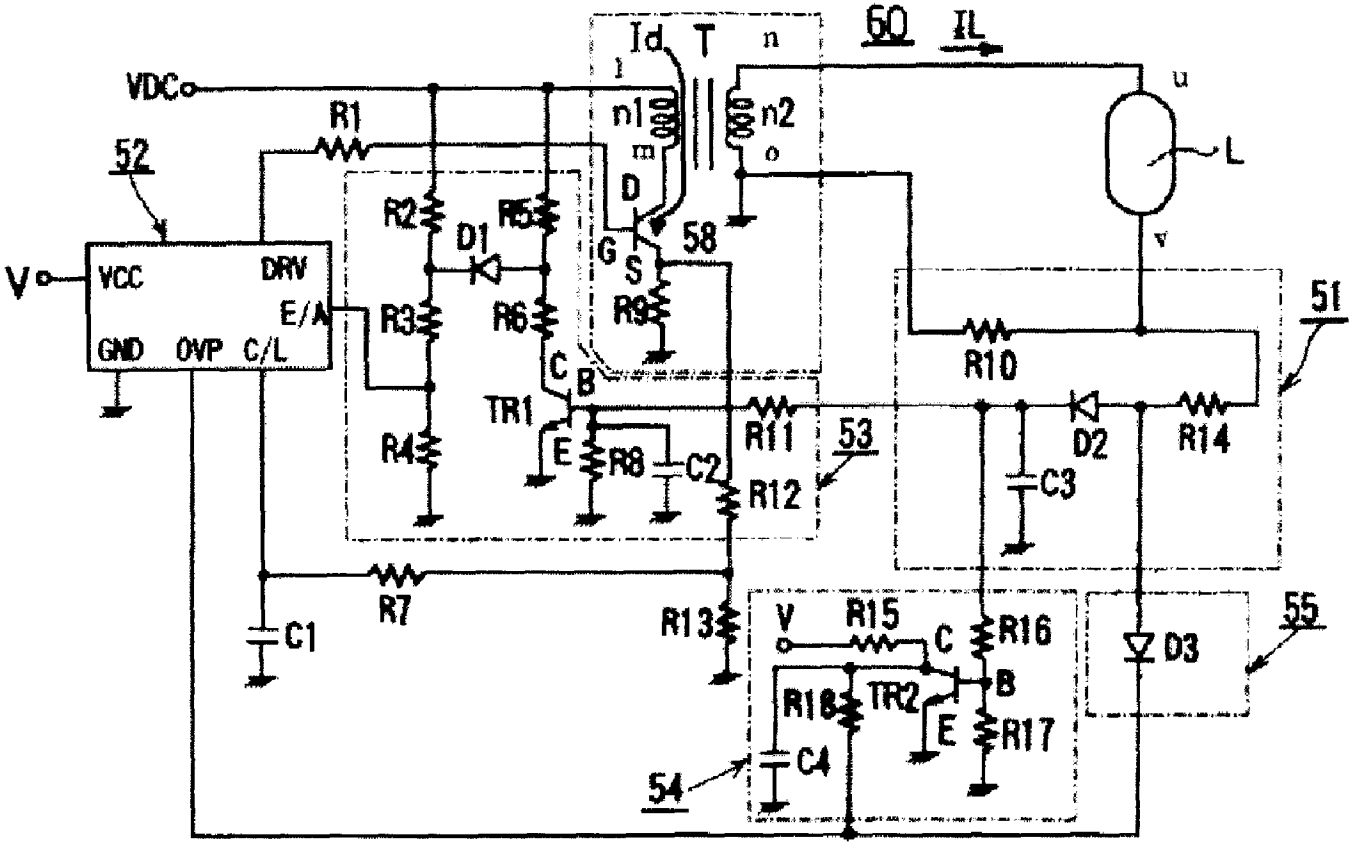
FIG. 3 (RELATED ART)
FIG. 3 is a diagram of a conventional discharge lamp lighting circuit with an open protection circuit.

Referring also to FIG. 2, a discharge lamp lighting circuit with an open protection circuit is detailed. The open protection circuit includes two open detecting circuits 81, 82 corresponding to the arrangement of two discharge lamps 5. Each of the open detecting circuits 81, 82 is used for detecting AC flowing through the corresponding discharge lamp 5. The open detecting circuits 81, 82 include resistors $R_1$, $R_2$, capacitors $C_1$, $C_2$, and transistors $TR_1$, $TR_2$ respectively. The delay circuit includes a capacitor $C_3$, and the open control circuit 10 includes a resistor $R_3$ and a diode $D_1$.

One end of the resistor $R_1$ is connected to the output terminal '$I_1$' of the discharge lamp $L_1$. The other end of the resistor $R_1$ is connected to a base terminal 'B' of the transistor $TR_1$ and one end of the capacitor $C_1$. The other end of the capacitor $C_1$ is grounded. A collector terminal 'C' of the transistor $TR_1$ is connected to a node 'y' between the resistor $R_3$ and the diode $D_1$. One end of the resistor $R_2$ is connected to the output terminal '$I_2$' of the discharge lamp $L_2$. The other end of the resistor $R_2$ is connected to a base terminal 'B' of the transistor $TR_2$ and one end of the capacitor $C_2$. A collector terminal C of the transistor $TR_2$ is connected to an emitter terminal 'E' of the transistor $TR_1$. An emitter terminal 'E' of the transistor $TR_2$ is connected to an end of the capacitor $C_3$, and is grounded. The other end of the capacitor $C_3$ is connected to a node 'z' between the diode $D_1$ and the resistor $R_3$. An anode of the diode $D_1$ is connected to one end of the resistor $R_3$, and a cathode of the diode $D_1$ is connected to the input terminal 'u' of the control circuit 1. A reference voltage is provided to the resistor $R_3$ from a terminal VCC.

The over-voltage detecting circuit 3 includes a voltage-regulator diode $ZD_1$, a resistor $R_4$, and a resistor $R_5$ connected in series. A cathode of the voltage-regulator diode $ZD_1$ is connected to a node 'x' between the buck converter 2 and the resonant converter 4. An anode of the voltage-regulator diode $ZD_1$ is connected to one end of the resistor $R_4$. The other end of the resistor $R_4$ is connected to the input terminal 'f' of the control circuit 1 and an end of the resistor $R_5$. The other end of the resistor $R_5$ is grounded.

At the very start of supplying power, the discharge lamps $L_1$ and $L_2$ are not lit, and therefore the AC flow through the lamps is zero. Consequently, the transistors $TR_1$ and $TR_2$ do not conduct, and the capacitor $C_3$ is charged by the terminal VCC until the charge is equal to the terminal VCC after a period of time has elapsed, which period of time is determined by the values of the capacitor $C_3$ itself. During this delay time, the potential at the anode of the diode $D_1$ does not reach a first determined voltage that allows conductance. Also during the delay time, if the discharge lamps $L_1$ and $L_2$ are lit, the discharge lamps $L_1$ and $L_2$ respectively output an AC. The capacitors $C_1$ and $C_2$ respectively convert the AC into a DC, and respectively supply the DC to the transistors $TR_1$ and $TR_2$, whereby the transistors $TR_1$ and $TR_2$ conduct the current. The capacitor $C_3$ then discharges to ground. As a result, the potential at the anode of the diode $D_1$ is reduced to zero, and therefore the diode $D_1$ does not conduct current.

After the initial ignition, the discharge lamps 5 are lit and enter a normal working state. During the normal working state, if one of the discharge lamps $L_1$ or $L_2$ is not lit, for example the discharge lamp $L_1$, then the output terminal '$I_1$' of the discharge lamp $L_1$ does not output AC, and therefore the transistor $TR_1$ does not conduct current. Consequently, the capacitor $C_3$ is charged by the terminal VCC until the charge is equal to the terminal VCC after a period of time has elapsed. Therefore the potential at the anode of the diode $D_1$ reaches the first determined voltage, and the diode $D_1$ conducts current and outputs the second voltage control signal to the control circuit 1. The control circuit 1 receives the second voltage control signal, and outputs the particular pulse signal with the predetermined duty cycle (e.g., one hundred percent) to the buck converter 2. The buck converter 2 outputs a higher voltage according to the particular pulse signal. Being driven by the higher voltage from the buck converter 2, the voltage-regulator diode $ZD_1$ conducts current and outputs the third voltage control signal to the control circuit 1. Upon receiving the third voltage control signal, the control circuit 1 ceases operating. Consequently, the buck converter 2 stops outputting the higher voltage to the resonant converter 4. Therefore, the resonant converter 4 and the discharge lamps 5 are protected from being damaged.

It should be emphasized that the above-described embodiments including preferred embodiments are merely possible examples of implementations, which are set forth for a clear understanding of the principles of the invention. Many variations and modifications may be made to the above-described embodiments. All such modifications and variations are intended to be included herein within the scope of this disclosure and the present invention, and protected by the following claims and their equivalents.

What is claimed is:

1. A discharge lamp lighting circuit comprising a control circuit, a buck converter, a resonant converter, one or more discharge lamps, and a feedback circuit, which are connected in series, wherein the discharge lamp lighting circuit further comprises:

an open protection circuit, which is connected to the discharge lamps and the control circuit, to detect whether any of the discharge lamps are unlit, and to send a voltage control signal to the control circuit if one of the discharge lamps is not lit, whereby the control circuit sends a pulse signal to the buck converter according to the voltage control signal, and the buck converter generates and outputs a direct current (DC) voltage according to the pulse signal; and an over-voltage detecting circuit, one end of which is respectively connected with the buck converter and the resonant converter, and the other end of which is connected to the control circuit;

wherein the over-voltage detecting circuit conducts current and sends a voltage control signal to the control circuit if the DC voltage from the buck converter reaches a predetermined voltage, and the control circuit ceases operating according to the voltage control signal.

2. The discharge lamp lighting circuit according to claim 1, wherein the open protection circuit further comprises one or more open detecting circuits, a delay circuit, and an open control circuit, wherein each open detecting circuit is connected to a respective one of the discharge lamps, the open detecting circuits are connected in series, and the open control circuit is connected to the control circuit.

3. The discharge lamp lighting circuit according to claim 2, wherein one output terminal of the open detecting circuit is connected to the open control circuit, and the other output terminal of the open detecting circuit is respectively connected to the delay circuit and ground.

4. The discharge lamp lighting circuit according to claim 3, wherein each open detecting circuit further comprises a resistor, a capacitor, and a transistor.

5. The discharge lamp lighting circuit according to claim 4, wherein one end of the resistor is connected to a discharge lamp, and the other end of the resistor is connected respectively to a base terminal of the transistor and one end of the capacitor, and the other end of the capacitor is grounded.

6. The discharge lamp lighting circuit according to claim 4, wherein a collector terminal of the transistor of one open detecting circuit is connected to the open control circuit, and an emitter terminal of the transistor of the open detecting circuit is connected to a collector of the transistor of another open detecting circuit or to one end of the delay circuit and ground.

7. The discharge lamp lighting circuit according to claim 2, wherein the open control circuit further comprises a resistor and a diode, one end of the resistor being connected to a reference voltage, the other end of the resistor being connected with an anode of the diode and one end of the delay circuit, and a cathode of the diode being connected to an open detecting circuit.

8. The discharge lamp lighting circuit according to claim 2, wherein the delay circuit comprises a capacitor, one end of the capacitor being connected to one open detecting circuit and ground, the other end of the capacitor being connected to the open control circuit.

9. The discharge lamp lighting circuit according to claim 1, wherein the over-voltage detecting circuit further comprises a voltage-regulator diode, a second resistor, and a third resistor, with a cathode of the voltage-regulator diode being connected to the buck converter, an anode of the voltage-regulator diode being connected to one end of the second resistor, and the other end of the second resistor being connected to the control circuit and to ground, the connection to ground being via the third resistor.

* * * * *